US005094432A

United States Patent [19]

Marguier et al.

[11] Patent Number: 5,094,432

[45] Date of Patent: Mar. 10, 1992

[54] CONTAINER FOR ADDING LIGHT METAL TO AN ALUMINIUM ALLOY IN THE LIQUID STATE

[75] Inventors: Alain Marguier, Vizille Gavet; Yves Petit, Ribecourt, both of France

[73] Assignee: Aluminium Pechiney, Courbevoie, France

[21] Appl. No.: 650,592

[22] Filed: Feb. 5, 1991

[30] Foreign Application Priority Data

Mar. 7, 1990 [FR] France ..... 9003360

[51] Int. Cl.[5] ..... C21C 7/00

[52] U.S. Cl. ..... 266/216; 75/526; 420/590

[58] Field of Search ..... 266/216; 75/526; 420/590

[56] References Cited

U.S. PATENT DOCUMENTS 4,043,798 8/1977 Nashiwa ..... 75/526

4,711,663 12/1987 Ferrari ..... 420/590

*Primary Examiner*—Peter D. Rosenberg

*Attorney, Agent, or Firm*—Dennison, Meserole, Pollack & Scheiner

[57] ABSTRACT

A container for adding to a liquid metal of known density and melting point an additive metal of lower density. The container comprises a tube portion of defined cross-section formed of a metal having a melting point higher than the melting point of the liquid metal and which can alloy with the liquid metal without being a source of pollution, and an insert comprising the additive metal placed within the tube portion. The tube portion has at least one end portion constricted so as to leave a passage with a cross-section smaller than the defined cross-section of the tube, the ratio of the passage cross-section to the tube cross-section being from 1:10 to 1:1000. The container overall has a density greater than the density of the liquid metal, so that it sinks when placed within a bath of the liquid metal. This invention finds application in modifying aluminum-silicon alloys with sodium, and additive metal which is lighter than and floats on a bath of liquid aluminum-silicon alloy.

9 Claims, 1 Drawing Sheet

CONTAINER FOR ADDING LIGHT METAL TO AN ALUMINIUM ALLOY IN THE LIQUID STATE

BACKGROUND OF THE INVENTION

The invention relates to a container for adding light metal to an aluminium alloy in the liquid state.

In metallurgical processes it is known to add light metals, such as alkali metals or alkaline earth metals, to other metals or alloys. In the preparation of aluminium-silicon, for example, it is common practice to make additions of a few ppm of sodium to the alloy in the liquid state, in order to give a fibrous structure to the eutectic system which develops when crystallisation takes place through cooling, and thereby to give the product obtained better mechanical properties.

In cases where ingots are produced the addition may be made in the melting furnace in the form of metallic sodium, or in the casting process in the feeding chute by means of aluminiun wire filled with sodium. In cases where moulded articles are produced the addition is also made in the feeding furnace in the form of flux or metallic sodium.

However, the addition cannot be made under the conditions which are normally used when other elements are added.

Alkali metals and alkaline earth metals in fact generally have a lower density than aluminiun, so if they are simply poured into the melting bath of alloy they will float to the surface and will not mix in well, even if agitated. As these metals are also very hygroscopic and oxidise easily in air, they will react at the surface of the bath and be converted to the hydroxide and/or carbonate form.

Hence the effectiveness of said metals is reduced. In addition to this effect, the presence of the products of the reaction gives rise to porosity or heterogeneousness which may make the alloy obtained brittle.

The addition must therefore be prevented from reacting at the surface, and for this purpose it must be inserted and completely dissolved within the bath. The resolution of this problem must be linked with the problem of excluding air during the storage and preliminary handling of the addition.

Solutions have indeed already been proposed, such as the use of bells, inside which the light metal is placed and which are immersed in the bath so that the metal cannot rise direct to the surface and the oxidation rate is therefore limited. However, since the area of exchange between the light metal and the bath is relatively large, the addition disperses too rapidly, so part of it still goes to the surface where it is degraded, thus reducing effectiveness by about 50%.

Other solutions consequently followed, usually consisting of placing the addition in a hermetically sealed container of the same type as the metal of the bath.

U.S. Pat. No. 3,848,391 describes the use of an aluminium box containing sodium or lithium and equipped with a fitting cover, for example for treating an aluminium-silicon alloy. The problem of excluding air during storage and handling of the addition is solved under these conditions, but not that of complete dissolution in the bath.

Since the boxes have a lower density than the bath, they tend to float. In addition, since the temperature of the bath is relatively higher than the melting point of aluminium, the box dissolves rapidly and liberates its contents abruptly. As a result sodium or lithium rises to the surface and there is a consequent oxidation reaction and loss of effectiveness.

SUMMARY OF THE INVENTION

In an effort to improve the dissolution rate of the addition, Applicants have therefore developed a metal container for inserting light metal in an aluminium alloy in the liquid state. It is characterised in that it comprises a portion of tube with the light metal placed inside it, the tube being made of a metal which has a melting point higher than that of the alloy and which can alloy with the latter without being a source of pollution, at least one end of the tube having a constricted portion, which leaves a passage of small cross-section from the outside to the light metal and which forms with the latter a unit of higher density than the alloy.

Thus the invention differs from U.S. Pat. No. 3,848,391 in comprising:

1. replacing the aluminium with a metal which has a higher melting point than the alloy
2. using a portion of tube where—instead of the ends being closed by a cover—at least one end is open over a cross section of very small area
3. obtaining a container—light metal unit with a higher density than the alloy.

As far as the first difference is concerned, the container takes much longer to alloy with the alloy than aluminium does. Hence its complete dissolution takes place when all the light metal has virtually spread throughout the alloy. Furthermore the metal forming the container may be a constituent of the alloy other than aluminium.

With regard to the second difference, since the container is submerged in the alloy, it is found, firstly, that the cross-section of passage enables the light metal to spread at relatively low speed, avoiding any untimely rising to the surface; secondly it is found that oxidation of the light metal is limited to a very small thickness. Thus any risk of pollution by hydroxides and/or carbonates is negligible even after a relatively long dwell time of the container in the air.

With regard to the third difference, since the density of the container—light metal unit is higher than that of the alloy, the container drops to the bottom of the liquid bath. The light metal escaping from the container must therefore dover the whole height of the bath before arriving at the surface, by which time it has virtually completely dissolved.

Under these conditions the addition is found to be 100% effective.

The metal used for the container is preferably selected from the group made up of copper, nickel and iron and is compatible with any alkali metals and alkaline earth metals. The ratio of the cross-section of passage to the external cross section of the tube is preferably from 1/10 to 1/1 000. Values outside this range cause the light metal to pass into the bath at speeds which are generally too high or too low but which may nevertheless be appropriate, either when the bath level is high enough to ensure complete dissolution even at high speed, or when the extension of the period of treatment resulting from the low speed has no disadvantage in carrying out the process.

In a preferred embodiment of the invention, the light metal is placed inside the container in the form of a wire, which may be either bare or sheathed in aluminium. A convenient method of making the container is to take a long tube, to insert a substantially equivalent length of wire in a dry, non-oxidising atmosphere and to seal the tube hermetically at the ends. It can thus be stored for a long time without any risk, of degradation.

When the tube is to be used it is divided into portions of appropriate length, corresponding to the weight of light metal to be inserted in the alloy. This is done by stretching or flattening the tube in the selected place, then by shearing so as to leave a passage which is then occupied by the section of the wire, thus preventing any oxidation of the light metal inside the tube. If a portion of unused tube is left over, it is then sealed hermetically, for example by crushing, at the shearing location so that it can be stored until the next time it is required.

DESCRIPTION OF THE PREFERRED EMBODIMENTS

Figure 1:
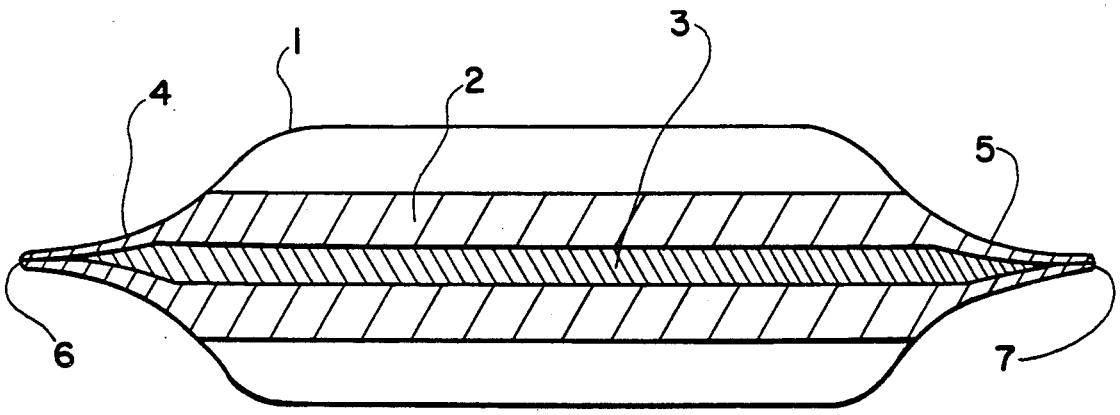
FIG. 1 is a longitudinal axial section through a container according to the invention.

The container of the invention shown in FIG. 1 comprises a portion of copper tube 1. It can be seen to comprise a portion of copper tube 1 with an aluminium wire 2 filled with sodium 3 placed inside it. The ends 4 and 5 of that portion each have a constricted part which leaves passages 6 and 7. When such a unit is submerged in a bath of alloy in the liquid state, it drops to the bottom where the sodium first melts then escapes through the openings 6 and 7, spreads gradually within the bath and dissolves completely before reaching the surface.

The invention may be illustrated by the following example of its application: Two ladles each contain 6000 kg of aluminium alloy, type A-S5U3 (i.e. containing 5% silicon and 3% copper by weight), at a temperature of 850°, the alloy being 1 m 50 high. Sodium is inserted in the two ladles in two different ways:

1) in the form of aluminium wire filled with sodium, which is placed in the metal filling connection of the ladle during casting. The effectiveness of the addition is approx. 75%.

2) in a container according to the invention. Effectiveness is then virtually 100%.

The main application for the container is in modifying aluminium-silicon alloys with sodium, where it gives approximately 100% effectiveness.

What is claimed is:

1. A metal container for adding light metal to an aluminium alloy in the liquid state, characterised in that it comprises a portion of tube with the light metal placed inside it, the tube being made of a metal which has a melting point higher than that of the alloy and which can alloy with the latter without being a source of pollution, at least one end of the tube having a constricted portion, which leaves a passage of small cross-section from the outside to the light metal and which forms with the latter a unit of higher density than the alloy.

2. The container of claim 1, wherein the tube portion is formed of a metal selected from the group consisting of copper, nickel and iron.

3. The container of claim 1, wherein the additive metal is selected from the group consisting of alkali metals and alkaline earth metals.

4. The container of claim 1, characterised in that the ratio of the cross-section of the opening to the external cross-section of the tube is from 1/10 to 1/1 000.

5. The container of claim 1, wherein the additive metal is placed within the tube in the form of wire.

6. The container of claim 5 wherein the additive metal is surrounded by an aluminium sheath.

7. A container for adding to a liquid metal of known density and melting point an additive metal of lower density, comprising:

a tube portion of defined cross-section formed of a metal having a melting point higher than the melting point of the liquid metal and which can alloy with the liquid metal without being a source of pollution; and an insert comprising the additive metal placed within said tube portion;

said tube portion having at least one end portion constricted so as to leave a passage with a cross-section smaller than the defined cross-section of the tube portion, the ratio of the passage cross-section to the tube portion cross-section being from 1:10 to 1:1000;

said container having a density greater than that of the liquid metal.

8. The container of claim 7, wherein the liquid metal is an aluminum alloy.

9. The container of claim 8, wherein the liquid metal is an aluminium-silicon alloy.

* * * * *